US005924663A

United States Patent [19]

Gatto

[11] Patent Number: 5,924,663

[45] Date of Patent: Jul. 20, 1999

[54] DISPLAY RACK FOR RETAIL MERCHANDISING

[75] Inventor: Simone P. Gatto, Shelby Township, Mich.

[73] Assignee: National In-Store Displays, Inc., Brookfield, Conn.

[21] Appl. No.: 08/946,343

[22] Filed: Oct. 7, 1997

Related U.S. Application Data

[60] Provisional application No. 60/028,238, Oct. 8, 1996.

[51] Int. Cl.[6] ..... A47B 96/06

[52] U.S. Cl. ..... 248/231.71; 248/243

[58] Field of Search ..... 248/231.71, 229.25, 248/229.15, 241, 243

[56] References Cited

U.S. PATENT DOCUMENTS

| | | | |
|---|---|---|---|
| 831,629 | 9/1906 | Rollman | 248/231.71 |
| 1,712,450 | 5/1929 | Cuno | 248/231.71 |
| 2,540,584 | 2/1951 | Jaycox | 248/229.25 |
| 2,920,855 | 1/1960 | Giebel | 248/231.71 |
| 3,030,639 | 4/1962 | Boyer | 248/231.71 |
| 3,262,666 | 7/1966 | Solum | 248/231.71 |
| 5,833,337 | 11/1998 | Kofstad | 248/243 |

*Primary Examiner*—Ramon O. Ramirez
*Assistant Examiner*—Robert Lipcsik
*Attorney, Agent, or Firm*—Finnegan, Henderson, Farabow, Garrett & Dunner, L.L.P.

[57] ABSTRACT

A side kick support bracket is for use in retail merchandise display support systems. The side kick support bracket includes an elongated bracket arm having an inner and outer surface with a rail clamping portion on the rear end of the inner surface. The rail clamping portion includes a rear flange, a front abutment tab, and a clamping device. The rear flange projects laterally from the inner surface at the rear end of the bracket to overly the exposed back and side surfaces of an end cap shelving rail. The front abutment tab is spaced forward of the rear flange and is adapted to lie against the front surface of the shelving rail, but does not extend so far as to cover the slots in the shelving rails. The clamping device operates between the rear flange and the back surface of the shelving rail to draw the abutment tab firmly against the exposed front surface of the shelving rail. Hangers are mounted on the outer surface of the bracket arm to support the wire side kicks.

7 Claims, 11 Drawing Sheets

DISPLAY RACK FOR RETAIL MERCHANDISING

REFERENCE TO RELATED APPLICATION(S)

This application claims priority rights under 35 U.S.C. § 119 on provisional U.S. patent application Ser. No. 60/028,238 filed on Oct. 8, 1996.

BACKGROUND OF THE INVENTION

1. Field of the Invention

The present invention relates generally to display shelving and supports for retail merchandising, and, more particularly, it concerns an end cap bracket for supporting wire display racks known in the trade as "side kicks."

2. Description of the Related Art

In large retail merchandising stores, merchandise is traditionally arranged on floor supported shelving that defines aisles through which consumers walk to observe the displayed merchandise. At the ends of each elongated shelving or display rack are panels known in the trade as "end caps." The end caps typically are formed by a panel of peg board supported between a pair of vertical rails. The rails are usually formed of hollow steel and are provided with slots in which shelving brackets may engage to support shelves at various heights across the peg board panel of the end cap.

The end caps of a retail shelving system offer space in which items may be merchandised by display on adjustable shelves secured to the end caps or in which items which may be suspended on hooks engaged in the peg board panels of the end caps. In addition, it is common practice in retail merchandising to employ wire racks or "side kicks" to take advantage further of the merchandising space available at the ends of the major shelving or display units.

Such side kicks have been traditionally supported in various ways, using the shelving bracket slots in the side rails of the end cap or by suspending the side kick from a shelf on the end cap. A problem presented to retail merchandisers is the interference of the shelving with the side kicks, or vice versa, in the sense that when the end cap is re-merchandised, both the side kicks and the shelves must be removed from the end caps.

SUMMARY OF THE INVENTION

An object of this invention is to provide a merchandise support system that will allow retail merchandisers to save time and effort when restocking or changing the merchandise on an end cap display unit.

Additional objects and advantages of the invention will be set forth in part in the description which follows, and in part will be obvious from the description, or may be learned by practice of the invention. The advantages and purpose of the invention will be realized and attained by the elements and combinations particularly pointed out in the appended claims.

To attain the advantages and in accordance with the purpose of the invention, as embodied and broadly described herein, the invention comprises a side kick bracket for an end cap in retail merchandise display shelving support systems. The bracket includes an elongated bracket arm having inner and outer surfaces, front and rear ends, and a rail clamping portion on the rear end of the inner surface. The rail clamping portion includes a rear flange, a front abutment tab, and a clamping device. The rear flange projects laterally from the inner surface at the rear end of the bracket to overly the exposed back surface of one of the vertical rails. The front abutment tab is spaced forwardly of the rear flange and projects laterally from the inner surface to a distal tab edge. The front abutment tab is adapted to lie against the exposed front surface of one of the pair of vertical rails. The clamping device operates between the rear flange and the back surface of the one of the vertical rails to draw the front abutment tab firmly against the exposed front surface of the one of the vertical rails. The bracket arm is also equipped with side kick hangers mounted on the outer surface of the bracket arm.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

Figure 1:
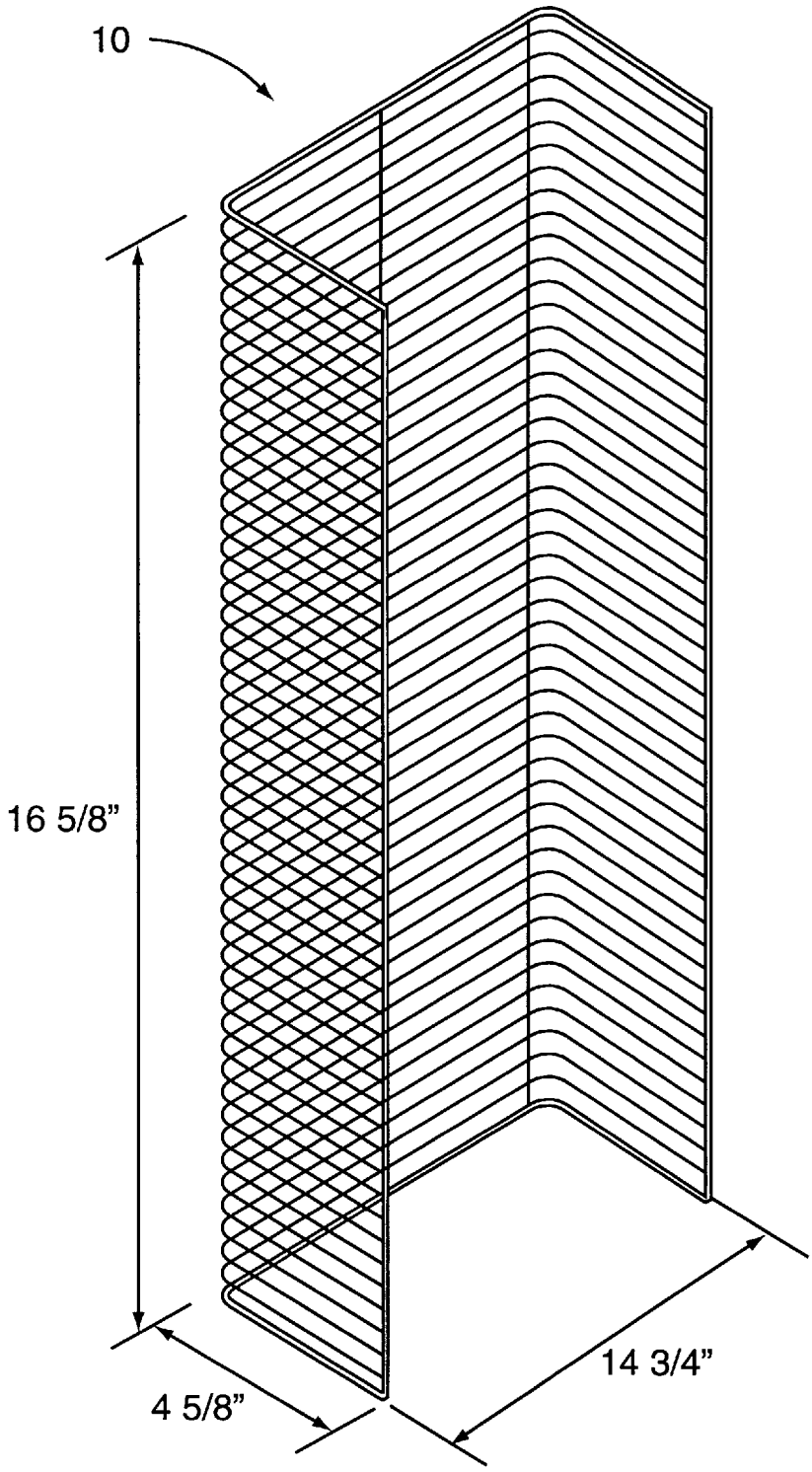
FIG. 1 PRIOR ART
FIG. 1 is an illustration of a conventional side kick.
Figure 2:
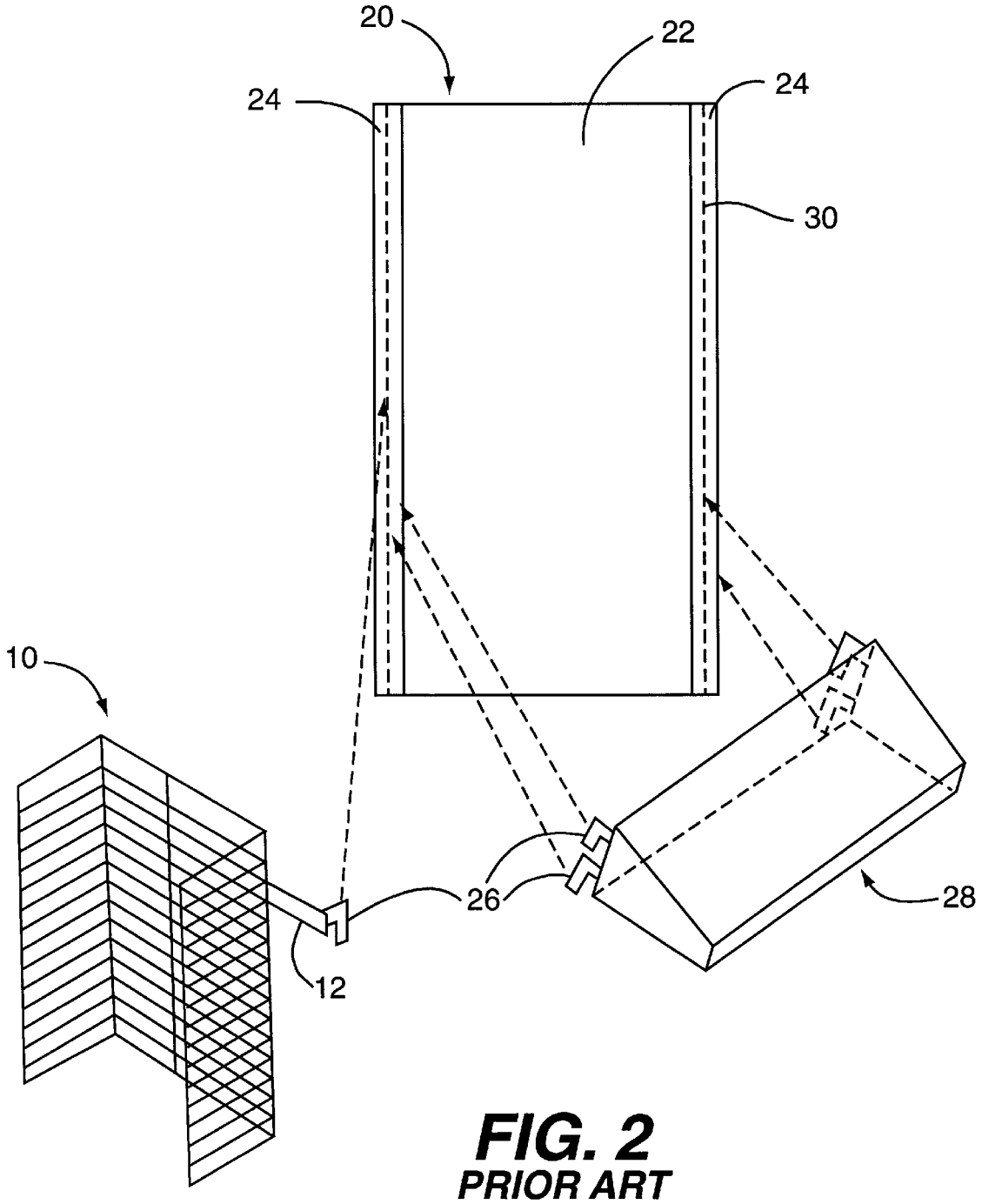
FIG. 2 PRIOR ART
FIG. 2 is an end view of the end cap structure together with shelving and side kick appendages known prior to the present invention.

The present invention is directed towards supports for retail merchandising display shelving. In particular, the invention concerns an end cap bracket for supporting wire display racks known in the trade as "side kicks." FIG. 1 shows a typical side kick 10. FIG. 2 shows a standard end cap 20. The end cap 20 includes a pair of vertical shelving rails 24 that are separated by a panel of peg board 22. Retailers use the end cap to support shelves 28 which have brackets 26 that engage the slots 30 of the shelving rails 24. Retailers may then display merchandise on the end cap shelves 28 or by suspending the merchandise from the panel of peg board 22 by use of conventional peg board hangers, for example.

Figure 3:
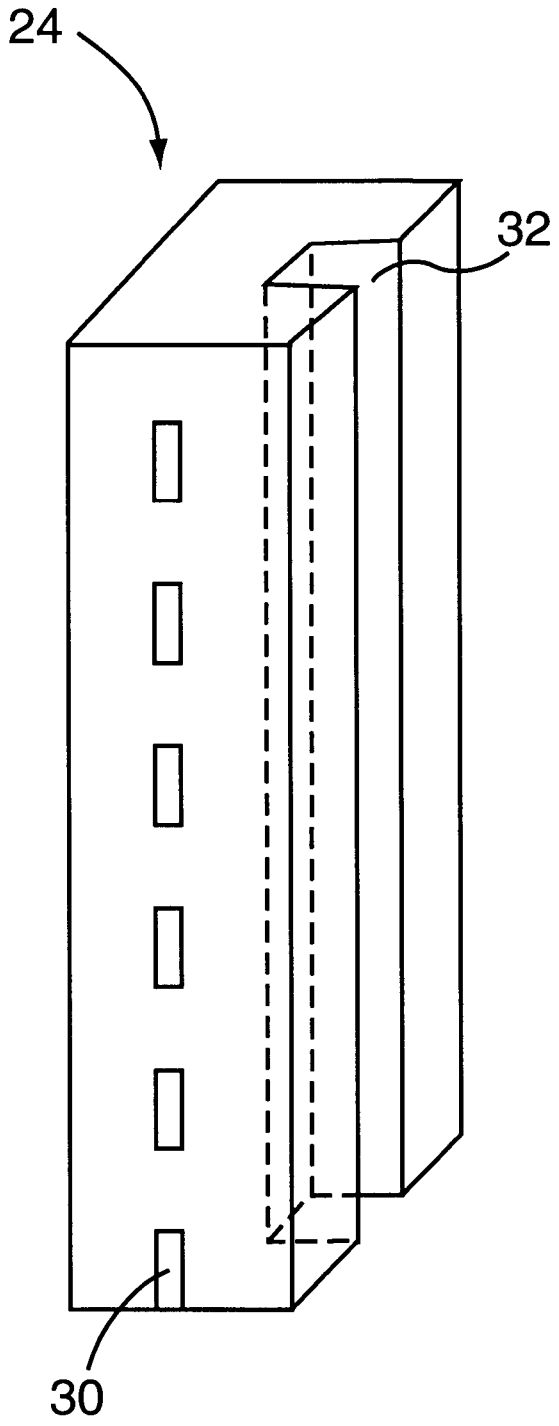
FIG. 3 PRIOR ART
FIG. 3 is an illustration of a conventional side kick shelving rail.

FIG. 3 shows a typical end cap shelving rail 24. The shelving rail 24 is essentially rectangular in cross section and has vertically spaced and vertically oriented shelf mounting bracket slots 30 on the exposed front surface. The shelving brackets 26 engage the bracket slots 30 as shown in FIG. 2. The shelving rail also has a groove 32 on one side of the rail that holds the panel of peg board 22 in place.

A current technique for supporting a side kick 10 is also shown in FIG. 2. The side kick 10 is typically supported with a bracket arm 12 that attaches to one of the shelving rails 24 with a standard shelving bracket 26. However, the end cap shelves 28 must also attach to the shelving rails 24 with shelving brackets 26. A problem occurs when the retailer desires to change the height of the end cap shelves 28 to accommodate new merchandise. If the new placement of the end cap shelves 28 overlaps with the placement of the side kick support, the retailer must unload the side kick 10 before repositioning the end cap shelves 28. Thus, significant time and effort is wasted in the loading and unloading of the side kick.

The present invention provides a side kick bracket that supports the side kick without the use of the standard shelving brackets 26 and slots 30. In the embodiment shown in FIG. 4*a*, the side kick bracket 40 is made of sheet steel to provide an elongated bracket arm 42 that supports a pair of side kick hanger tabs 66. The hanger tabs 66 attach to the outer surface 46 of the bracket arm 42 with a fastener 68 that engages with nuts 48 that are attached to the inner surface 44 of the bracket arm 42. The hanger tabs 66 and nuts 48 are offset from the front end 50 of the bracket arm 42. The rear end 52 of the bracket 40 is adapted to be supported from the shelving rails of an end cap by a "J" shaped hook 54 that engages the back and opposite side surfaces of a shelving rail 24. The J-shaped hook 54 extends from the inner surface 44 at the rear end 52 of the bracket arm 42. The J-shaped hook 54 is comprised of a rear flange 56 and an opposite side flange 62. An abutment tab 58 engages the front surface of the shelving rails 24. A set screw 60 effectively clamps the side kick bracket 40 to the end cap shelving rail. The bracket is preferably formed of steel powder coated in various colors.

Figure 5:
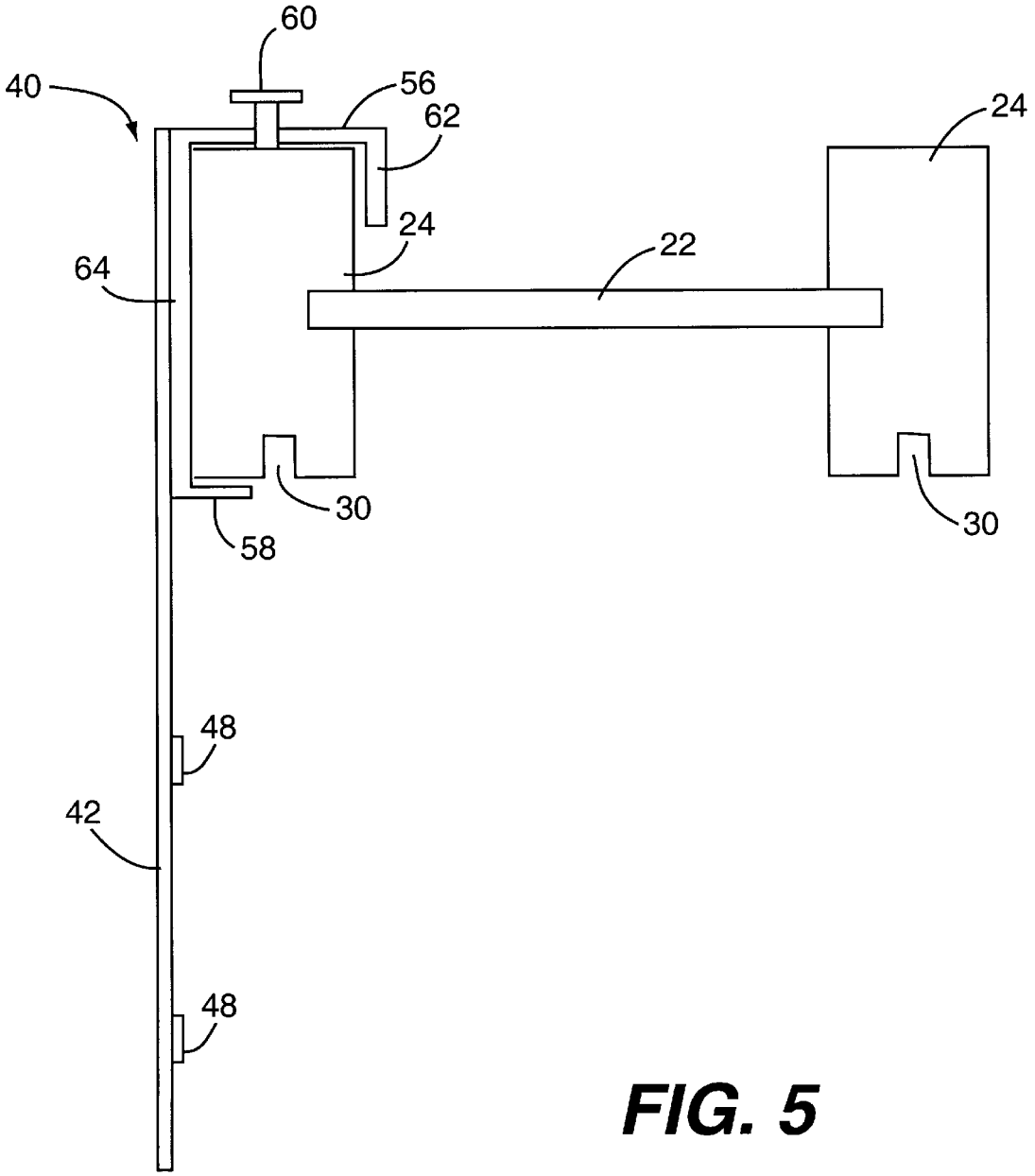
FIG. 5 is a top plan view showing the connection of the bracket of the invention with an end cap.

To mount the bracket of the invention, the bracket 40 is positioned so that it wraps around the shelving rail 24 of an end cap, as depicted in FIG. 5. The abutment tab 58 does not extend sufficiently over the front surface of the shelving rail 24 to cover the shelf slots 30 therein. Once the bracket is in the desired position, the set screw 60 is tightened to engage the clamping device. The tightening of the set screw 60 draws the abutment tab 58 firmly against the front surface of the shelving rail 24, effectively locking the bracket 40 in place. Retailers can then attach the side kick 10 to the bracket 40 with the hanger tabs 66.

It is significant that the bracket 40 does not interfere in any way with the shelf slots 30 in the shelving rails 24 of the end cap. As shown in FIG. 5, the abutment tab 58 stops short of covering the shelf slots 30. This feature allows retailers to re-merchandise the end cap without removal of the side kicks and the side kicks may be re-stocked without interference with the merchandise carried on the shelves or the panel of the end cap.

Figure 4A:
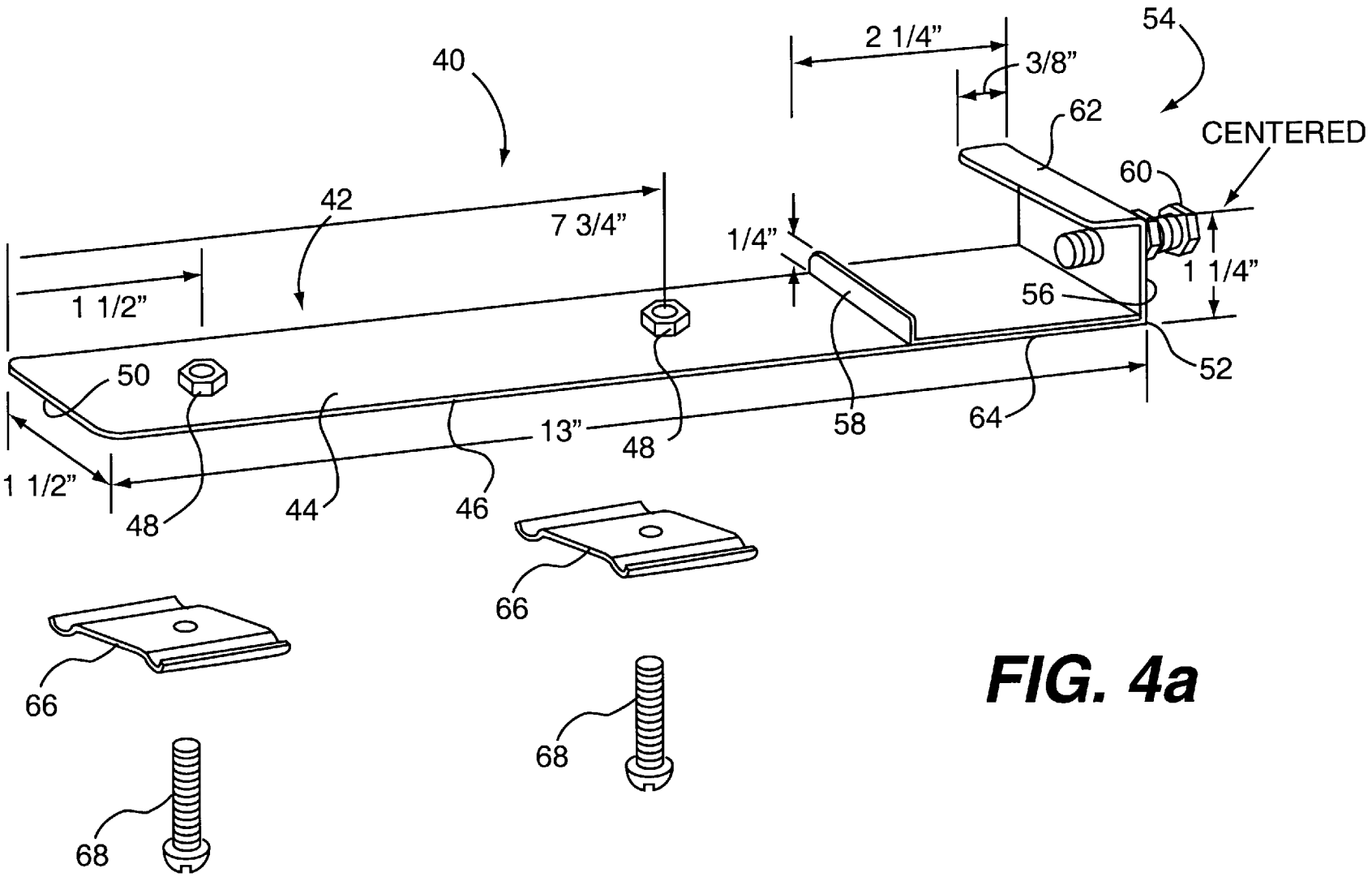
FIGS. 4*a*–4*g* show different embodiments of the side kick bracket.
Figure 4B:
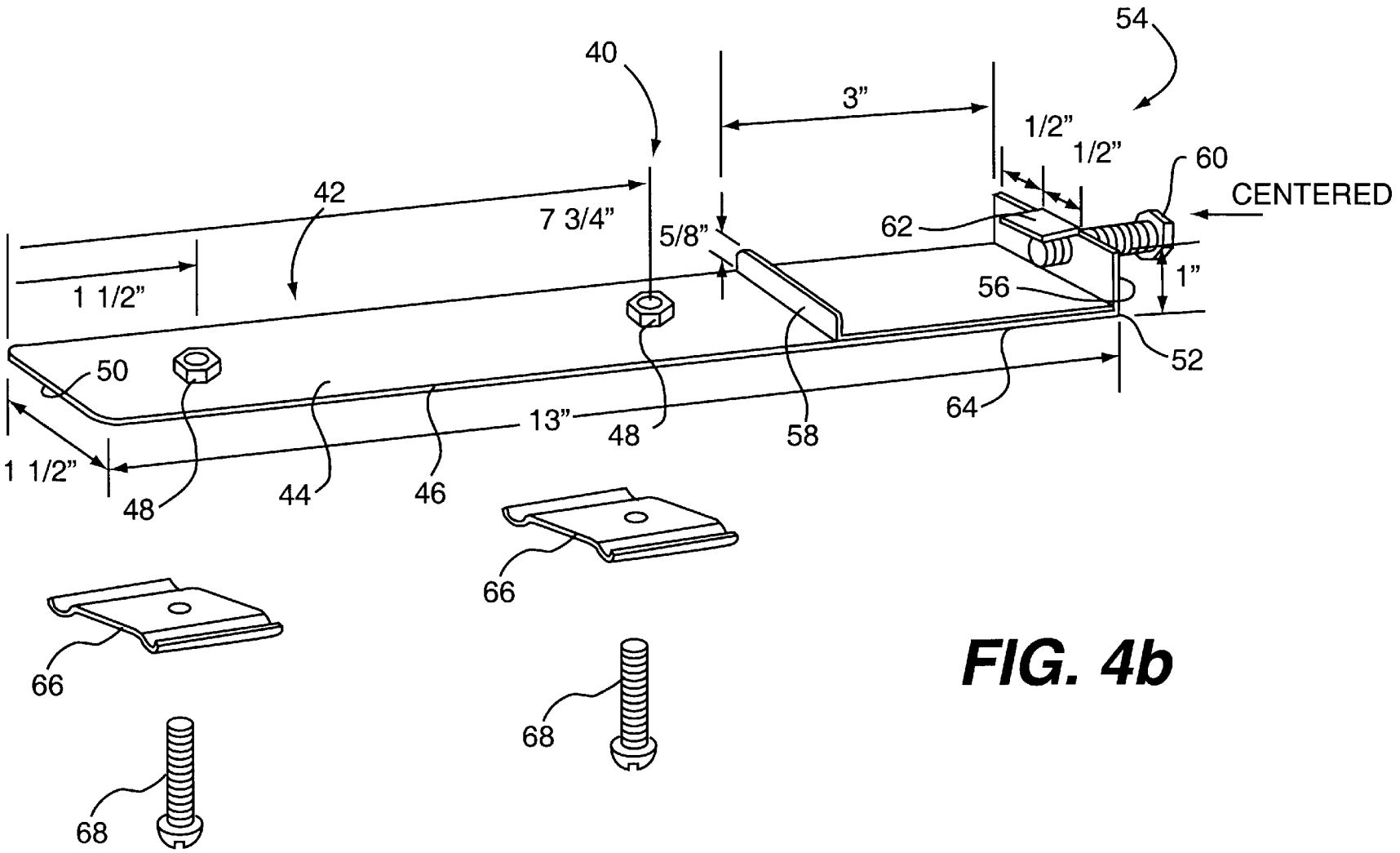
Figure 4C:
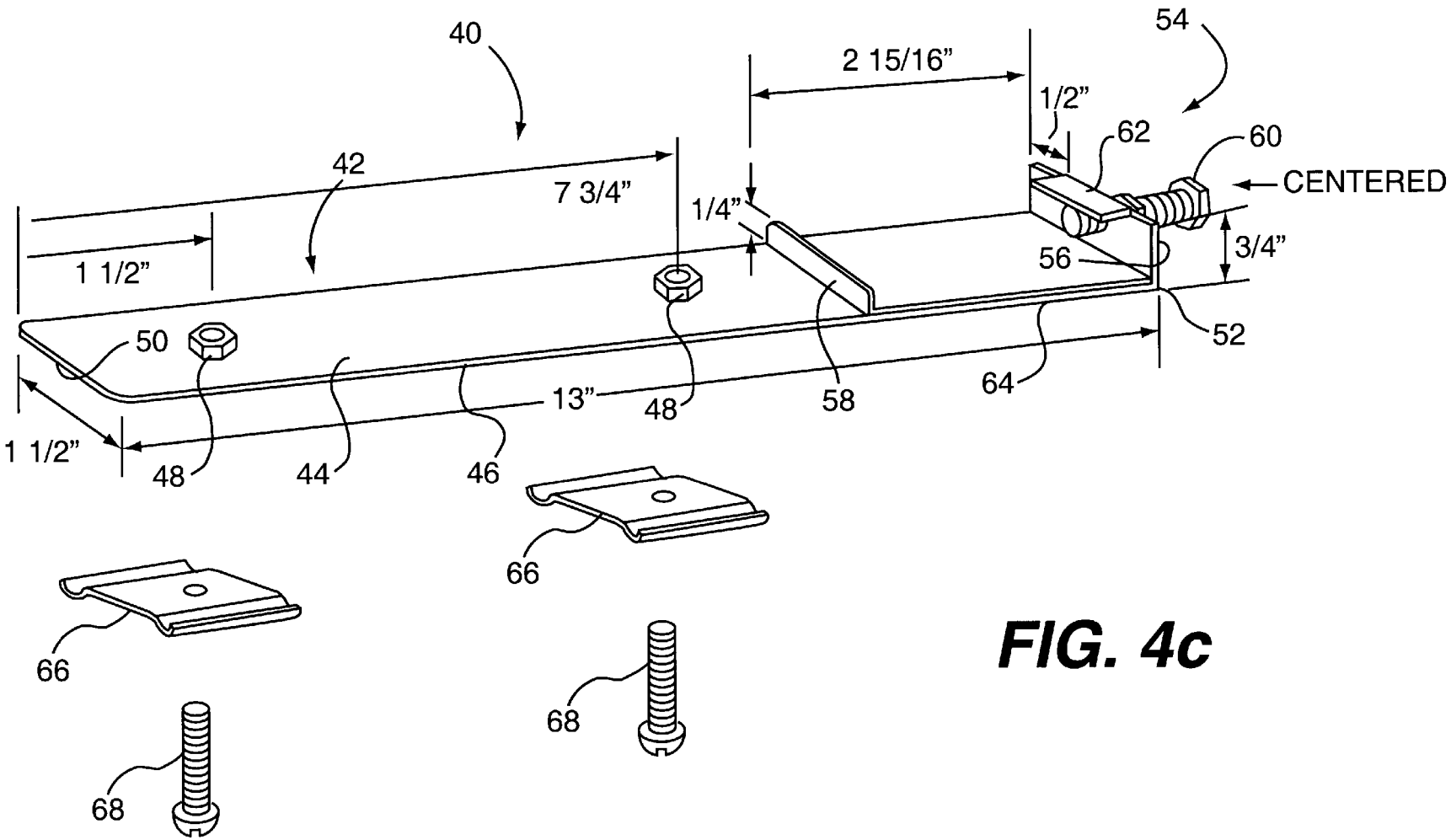
Figure 4D:
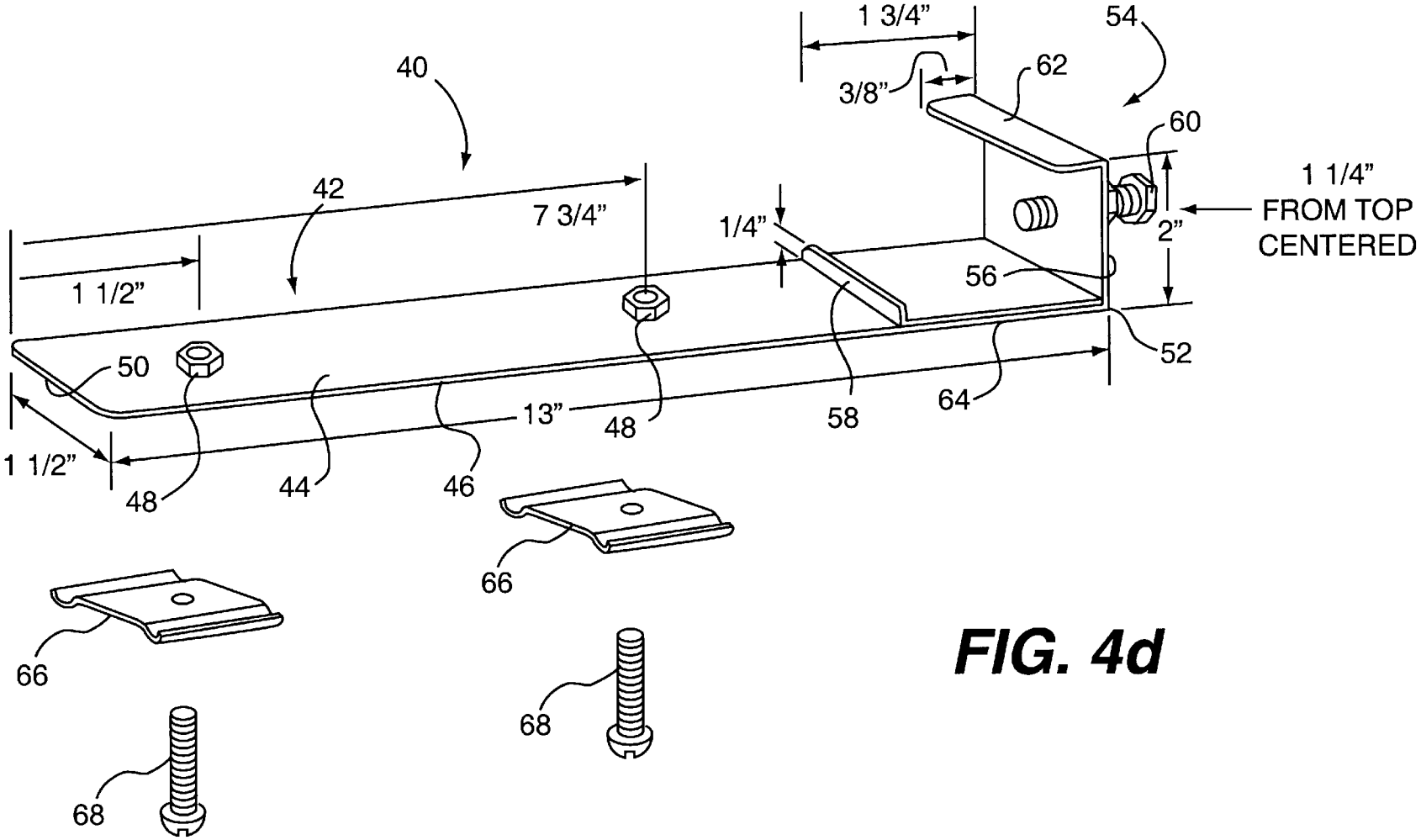
Figure 4E:
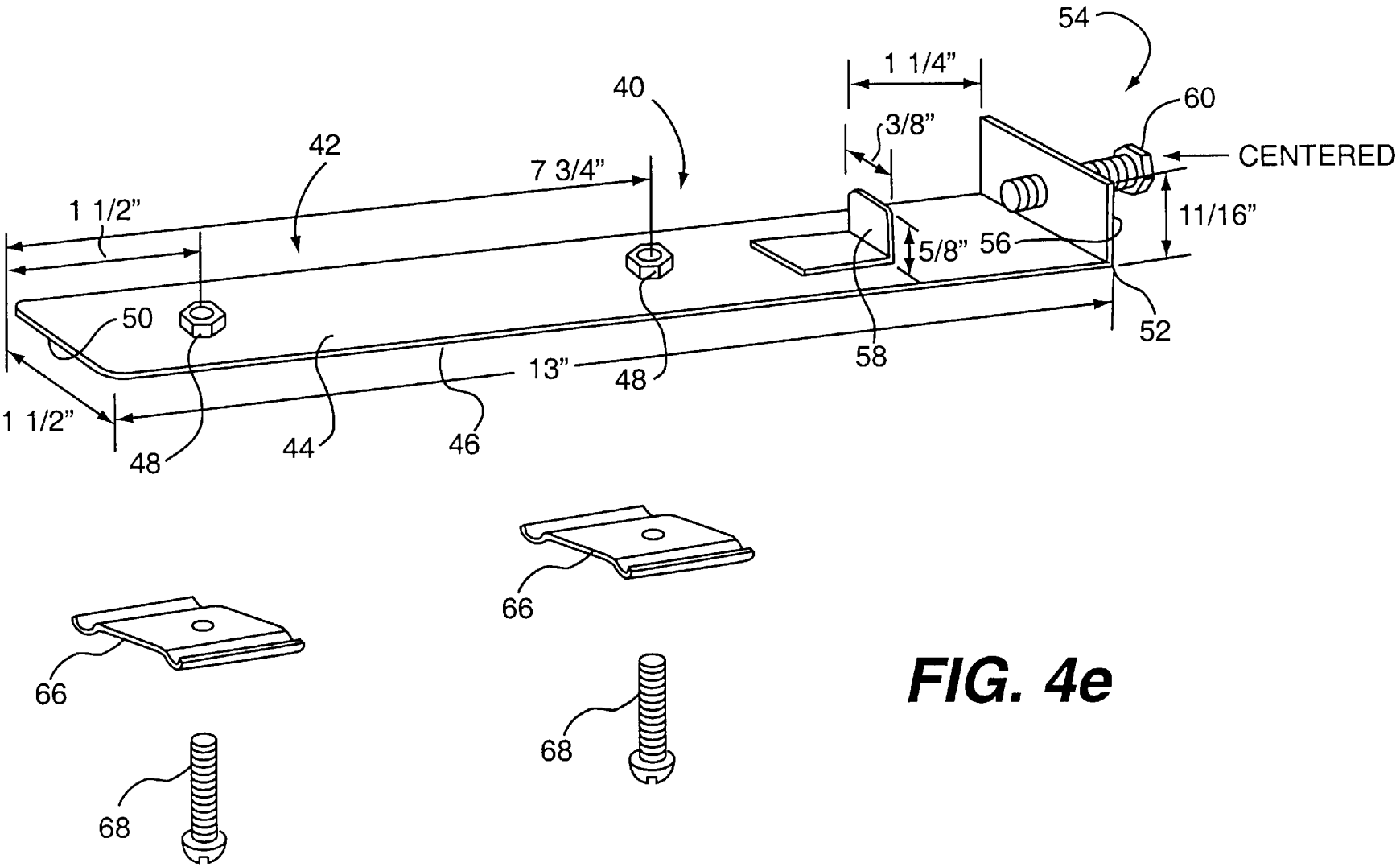
Figure 4F:
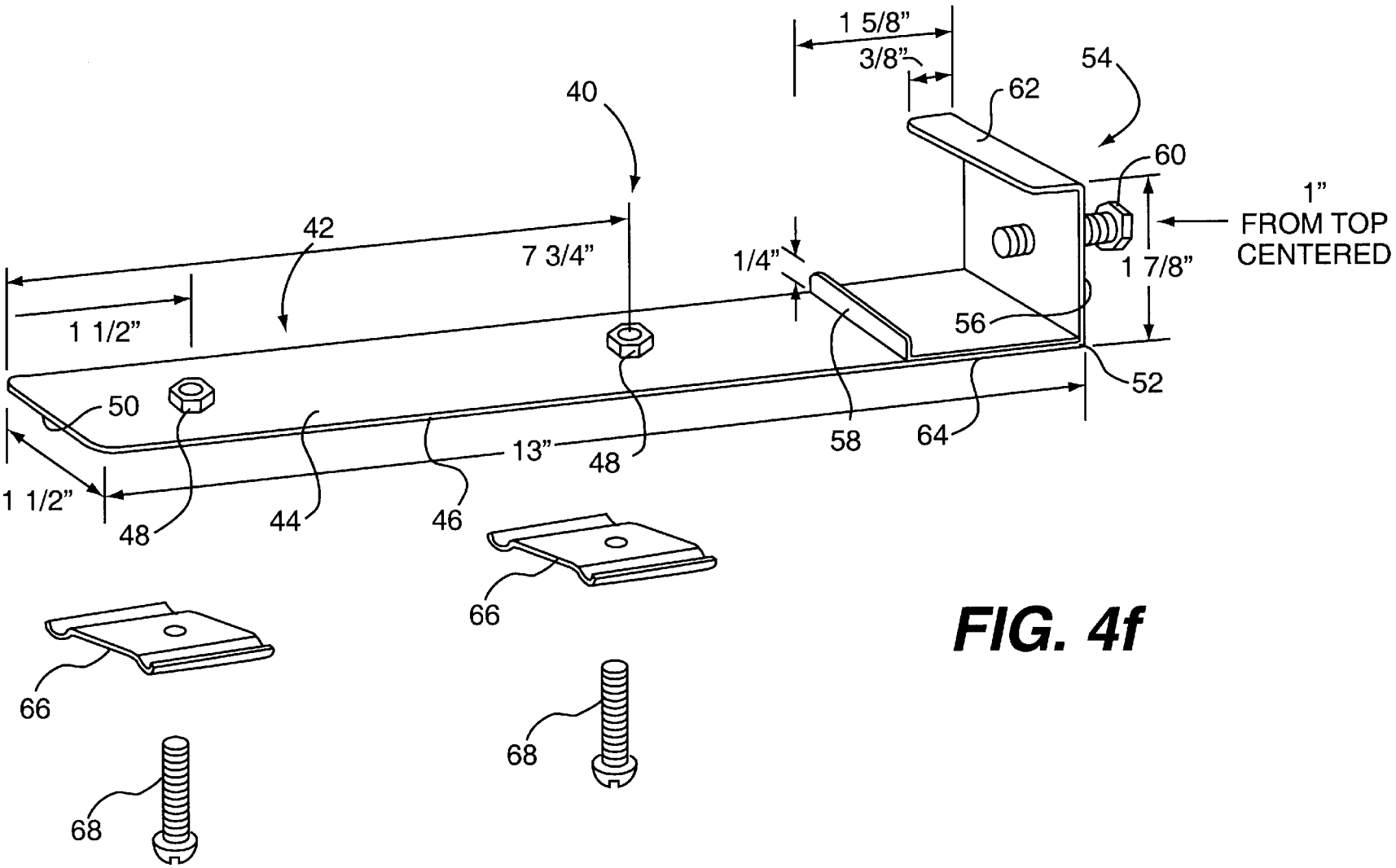
Figure 4G:
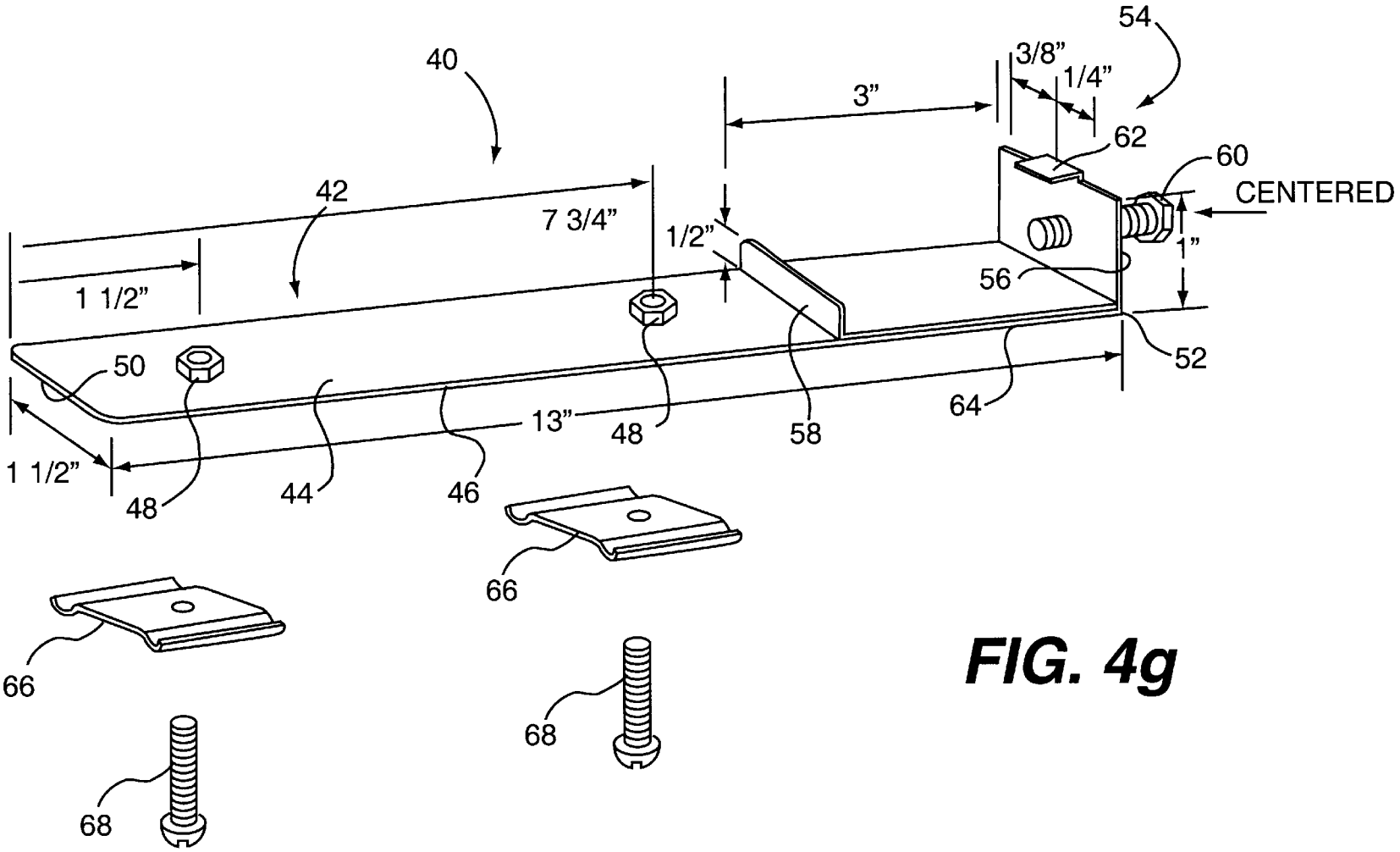

FIGS. 4*a*–4*g* show different embodiments of the bracket 40. There are several different sizes of end cap shelving rails and FIGS. 4*a*–4*g* show examples of the present invention that were designed to fit existing shelving rails. In the exemplary embodiments, the abutment tab 58 is located anywhere from 1.25" in FIG. 4*e* to 3" in FIGS. 4*b* and 4*g* from the rear end 52 of the bracket, depending on the dimensions of the end cap shelving rails. The length of the section of the rear flange 56 that engages the back surface of the shelving rail varies in length from 0.75" in FIG. 4*c* to 2" in FIG. 4*d*. FIGS. 4*a*–4*g* also show several variations on the opposite side flange 62 that engages the opposite side of the shelving rail. In FIGS. 4*a*, 4*d* and 4*f*, the opposite side flange 62 extends the width of the bracket arm 42. However, as shown in FIGS. 4*b*, 4*c*, and 4*g*, the opposite side flange 62 can be narrower than the width of the bracket arm 42 and can be of varying length. In the embodiment of FIG. 4*e* the invention is shown without an opposite side flange 62.

FIGS. 4*a*–4*g* also show different methods of construction. In FIGS. 4*a*, 4*b*, 4*c*, 4*d*, 4*f* and 4*g*, the rear flange 56, opposite side flange 62, and abutment tab 58 are made of a separate piece of metal that is shaped separately and attached to the bracket arm 42. As shown in FIG. 5, this results in a shim 58 that is located between the shelving rail 24 and the bracket arm 42. The shim 64 has the beneficial effect of spacing the bracket arm 42 away from the shelving rail 24, such that the nuts 48 will not interfere with the shelves.

Another method of construction is shown in FIG. 4*e*. In this embodiment, the abutment tab 58 is formed from a separate piece of metal that is welded to the bracket arm 42. In this embodiment, there is no shim 64 and the bracket arm 42 lies flush against the shelving rail.

Another method of construction is to fabricate the abutment tab 58, rear flange 56, and opposite side flange 62 out of the same piece of metal as the bracket arm 42. Alternatively, the abutment tab 58 may be pressed out of the bracket arm 42, while the rear flange 56 and the opposite side flange 62 are shaped out of separate piece of metal.

It will be apparent to those skilled in the art that various modifications and variations can be made in the side kick support bracket of the present invention and in construction of this side kick support bracket without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A side kick bracket in combination with an end cap in retail merchandise display shelving support systems, the end cap having a pair of vertical rails, each of generally rectangular cross-section to provide an exposed front surface, an exposed back surface and at least one exposed side surface, the front surface having vertically spaced and vertically oriented shelf bracket mounting slots spaced from the exposed side surface, the side kick bracket comprising:

an elongated bracket arm having inner and outer surfaces, front and rear ends, and a rail clamping portion on the rear end of the inner surface;

the rail clamping portion having a rear flange projecting laterally from the inner surface at the rear end of the bracket to overly the exposed back surface of one of the vertical rails, a front abutment tab spaced forwardly of the rear flange, projecting laterally from the inner surface to a distal tab edge, and adapted to lie against the exposed front surface of the one of the pair of vertical rails, and a clamping device operative between the rear flange and the back surface of the one of the vertical rails to draw the front abutment tab firmly against the exposed front surface of the one of the vertical rails; and side kick hangers mounted on the outer surface of the bracket arm;

the front abutment tab having a projecting length no greater than the distance the vertically oriented shelf bracket mounting slots are spaced from the exposed side surface of each of the vertical rails so that the vertically oriented slots remain accessible inside the distal tab edge.

2. The combination of claim 1, wherein the clamping portion includes a base secured to the inner surface of the bracket arm, at least the abutment tab being a struck out part of the base.

3. The combination of claim 1, wherein the clamping portion includes a base secured to the inner surface of the bracket arm, the abutment tab and the rear flange being struck out parts of the base.

4. The combination of claim 3, wherein the base of the clamping portion is of a thickness to space the inner surface of the bracket arm outwardly from the exposed outer surface of the one of the vertical rails.

5. The combination of claim 1, wherein the clamping device comprises a set screw positioned in the rear flange that operates on the back surface of the one of the vertical rails to draw the front abutment tab firmly against the exposed surface of the one of the vertical rails.

6. The combination of claim 1, wherein the rear flange extends to overly both the back surface and the opposite side surface of the vertical shelving rail.

7. The combination of claim 6, wherein the section of the rear flange that extends to overly the opposite side surface of the one of the vertical rails has a width smaller than the width of the portion of the flange that extends to overly the back surface of the one of the vertical rails.

* * * * *